US006474017B1

(12) United States Patent
White

(10) Patent No.: US 6,474,017 B1
(45) Date of Patent: Nov. 5, 2002

(54) PACKAGING FOR CUT FLOWERS

(75) Inventor: Stephen White, Upwey (AU)

(73) Assignee: Tesselaar Nominees Pty Ltd. (AU)

( * ) Notice: Subject to any disclaimer, the term of this patent is extended or adjusted under 35 U.S.C. 154(b) by 0 days.

(21) Appl. No.: 09/673,036

(22) PCT Filed: Apr. 8, 1999

(86) PCT No.: PCT/AU99/00262

§ 371 (c)(1),
(2), (4) Date: Jan. 17, 2001

(87) PCT Pub. No.: WO99/52792

PCT Pub. Date: Oct. 21, 1999

(30) Foreign Application Priority Data

Apr. 9, 1998 (AU) ..... PP2905

(51) Int. Cl.[7] ..... A01G 5/00
(52) U.S. Cl. ..... 47/41.01
(58) Field of Search ..... 47/58, 41 R, 41.01, 47/34.11; 206/422, 423; 220/555, 819

(56) References Cited

U.S. PATENT DOCUMENTS

| | | | | |
|---|---|---|---|---|
| 724,384 A | * | 3/1903 | Ferres | 206/422 |
| 5,060,799 A | * | 10/1991 | De Pagter | 206/423 |
| 5,605,246 A | * | 2/1997 | Rausch, Sr. et al. | 220/556 |
| 6,138,863 A | * | 10/2000 | Aiken | 220/819 |

FOREIGN PATENT DOCUMENTS

| | | |
|---|---|---|
| EP | 0881167 A | 12/1998 |
| JP | 07291363 A | 11/1995 |
| NL | 1004335 A | 10/1996 |
| NL | 1004382 A | 10/1996 |

* cited by examiner

*Primary Examiner*—Charles T. Jordan
*Assistant Examiner*—Francis T. Palo
(74) *Attorney, Agent, or Firm*—Cantor Colburn LLP

(57) ABSTRACT

A package for cut flowers comprising a supporting sleeve having opposed sides having upper edges formed with an array of slots, and cut flowers supporting cards having openings which receive the stems of the cut flowers, each card being formed with lugs which engage the slots to suspend the cards on the sleeve.

10 Claims, 3 Drawing Sheets

PACKAGING FOR CUT FLOWERS

CROSS REFERENCE TO RELATED APPLICATION

This application is a National Stage Entry of International Application No. PCT/AU99/00262 filed on Apr. 8, 1999.

FIELD OF THE INVENTION

This invention relates to packages for cut flowers, such as gerberas.

BACKGROUND OF THE INVENTION

In the past, cut flowers such as gerberas have been supported for display and sale by a card having stem receiving holes through which the stems are threaded to allow the stems to lic substantially in the plane of the card. It is common for cut flowers supported in this way to be stacked during handling and transport, and this often results in the flowers and stems being damaged since the flowers are essentially unprotected and the stems could be damaged due to the rigid nature of the card. Typically, about 10% of the flowers are damaged in this way leading to significant losses.

SUMMARY OF INVENTION AND OBJECT

It is an object of the present invention to provide an improved package for cut flowers in which the above problems are at least ameliorated.

The invention provides a package for cut flowers comprising a supporting sleeve having opposed sides with upper and lower edges, at least one pair of slots in the upper edges of opposed sides of the sleeve, and a cut flower supporting card having openings adapted to receive the stems of the cut flowers, said card being formed with shaped means at its sides which engage the slots to suspend the card within the sleeve to thereby support and protect the cut flowers.

In a preferred embodiment, the package includes a multiplicity of cards and associated spaced pairs of slots arranged to support the cut flowers with the flower heads spaced from each other to reduce damage during transportation and handling. The shaped means includes shaped lugs including slots for engaging the base of each side slot to locate and support the card.

The supporting sleeve is preferably mounted on a ventilated container capable of holding water so that the stems of the cut flowers are able to be immersed in the water. A ventilated lid preferably closes the top end of the sleeve to form an enclosed package for transporting the cut flowers.

BRIEF DESCRIPTION OF THE DRAWINGS

One preferred embodiment of the invention will now be described with reference to the accompanying drawings in which.

DESCRIPTION OF PREFERRED EMBODIMENT

Figure 1:
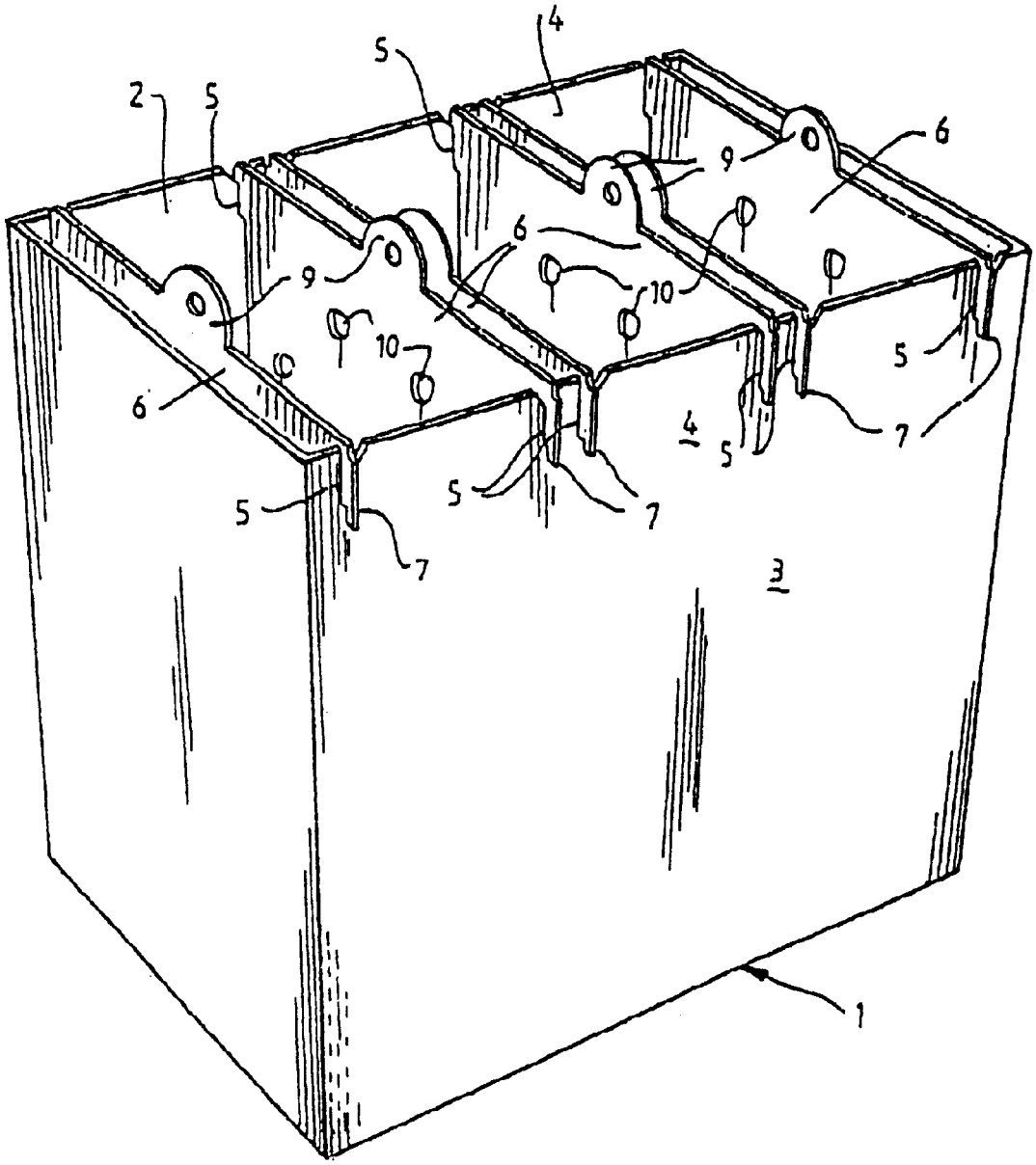
FIG. 1 is a perspective view from above of a package embodying the invention.
Figure 2:
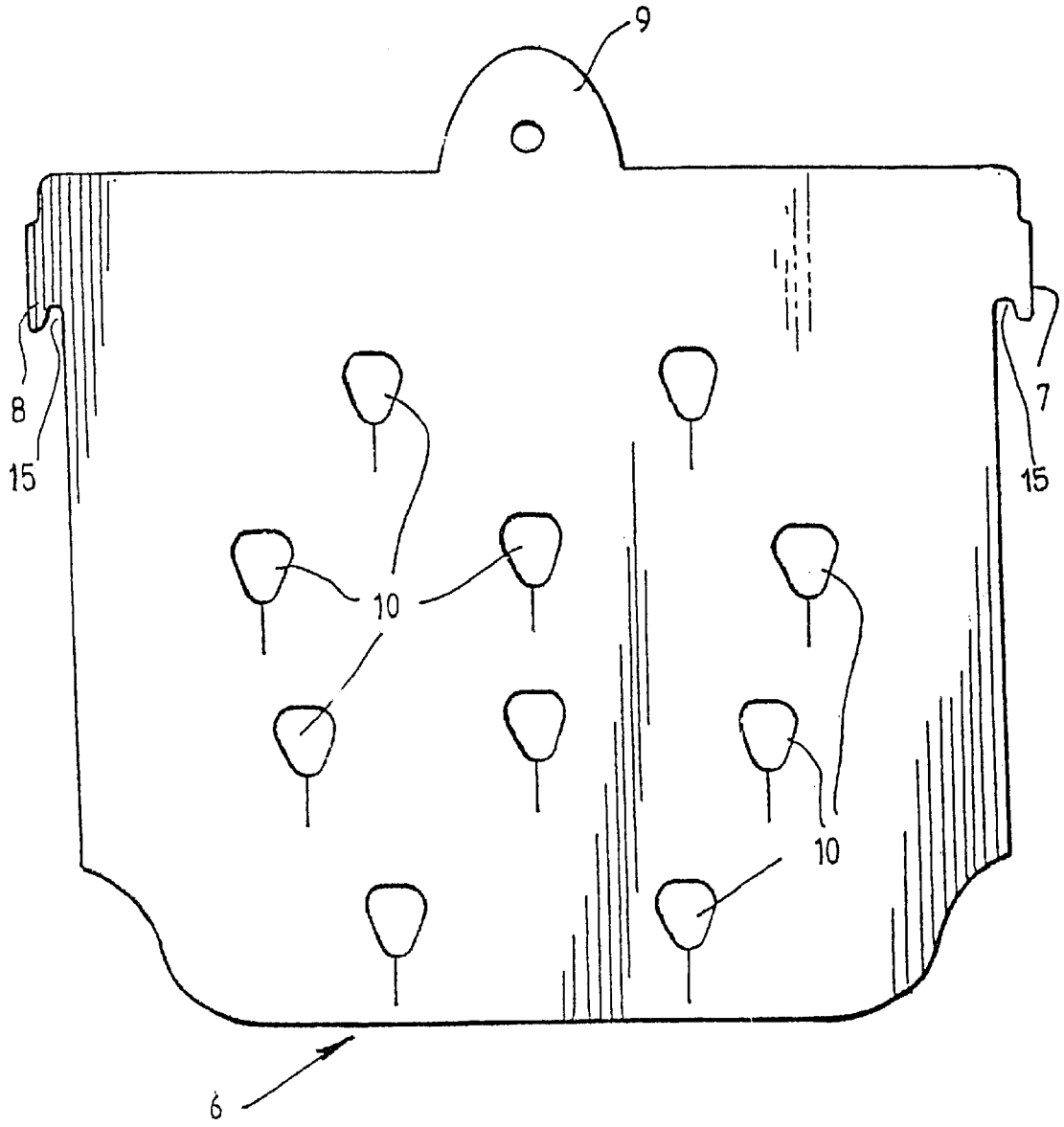
FIG. 2 is a plan view of a flower supporting card forming part of the package of FIG. 1.

Referring firstly to FIGS. 1 and 2 of the drawings, the package includes a supporting sleeve 1 having opposed sides 2, 3, having upper edges 4 each formed with an array of slots

5 as illustrated. Each opposed pair of slots 5 is engaged by a cut flower supporting card 6 having sides formed with lugs 7, 8 for engaging the slots 5 to suspend an array of cards 6 in the manner shown in FIG. 1. Each of the lugs 7, 8 includes slots 15. The lugs 7, 8 with the slots 15 engage the base of respective slots 5 in the sides 2, 3. Each card has a top tab 9 for supporting the card for display purposes and an array of stem receiving openings 10 in any desired pattern depending on the cut flower being packaged.

The slots 5 are spaced in the manner shown in FIG. 1 of the drawings to enable cut flowers to be supported on opposite sides of adjacent cards 6 with the stems of the flowers projecting between the adjacent cards 6, or in the case of the end cards, between the card 6 and the ends of the sleeve. In this way, the cut flowers are supported in an upright manner with the flower heads spaced from each other thereby reducing the likelihood of damage and prolonging the life of the cut flowers during transport and storage.

Figure 3:
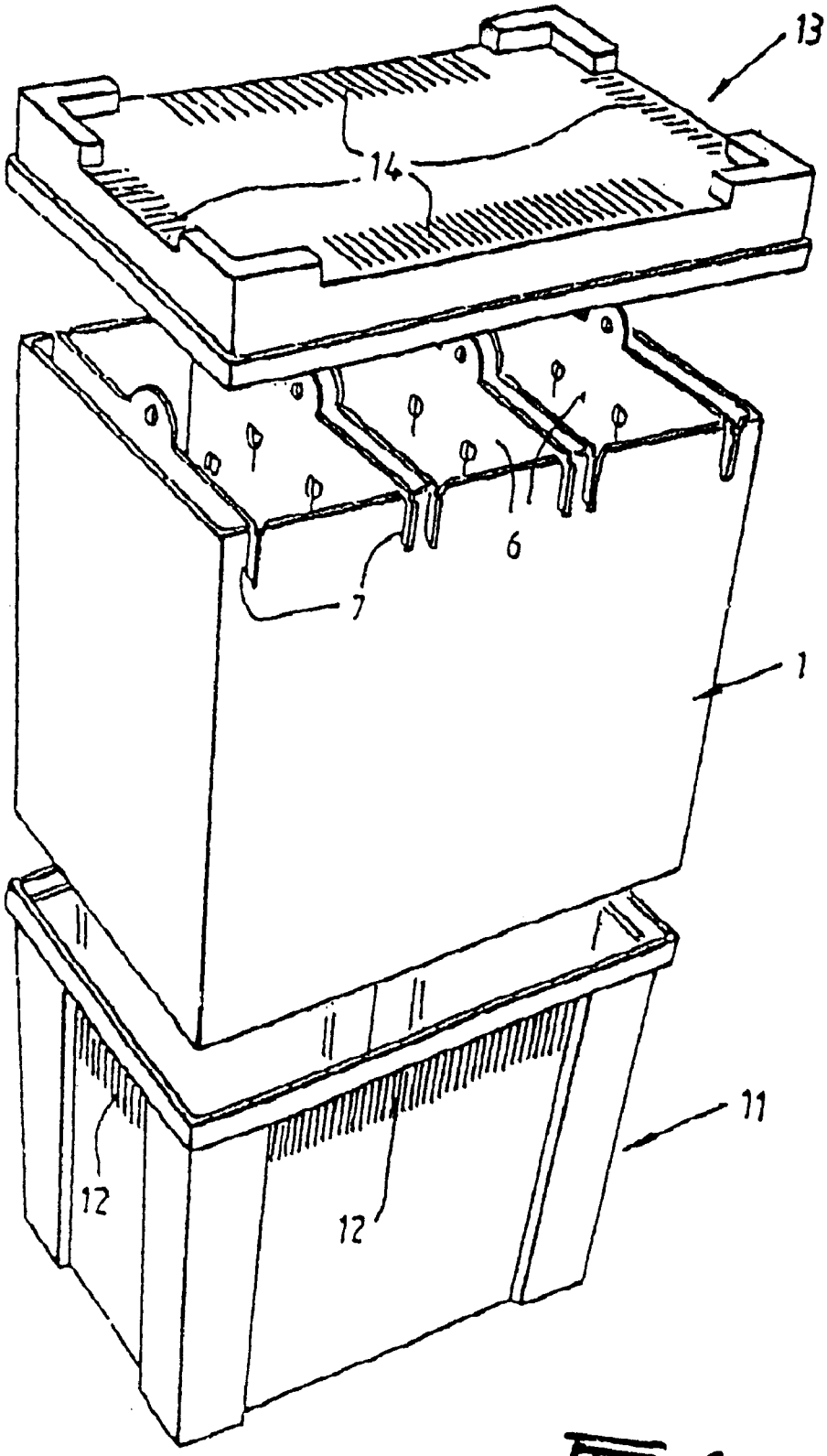
FIG. 3 illustrates a transporting package including an associated container and lid for completing the package.

The sleeve 1 is adapted to be supported for transportation and storage by a ventilated bucket or container 11 having air vent slots 12, and closed by a ventilated lid 13 having air vent slots 14, as illustrated in FIG. 3 of the drawings. The lid 13 is moulded to support the base of the bucket 11 so that buckets can by stacked one on top of the other.

The sleeve 1 and the cards 6 can be made from any suitable material, such as cardboard, corrugated cardboard or corrugated plastics material. The bucket and lid are preferably moulded from a lightweight plastics material.

The suspension of the cards 6 by the sides 2 and 3 of the sleeve 1 causes the cut flowers supported by the cards to be held in a natural orientation with their stems directed downwardly, which in turn facilitates the supply of water to the cut flowers. The spacing of the cards 6 in the manner illustrated also maintains the heads of the cut flowers spaced from each other thereby reducing the likelihood of damage by contact between the cut flowers.

It will also be appreciated that various modifications and alternations may be made to the system described above without departing from the scope and spirit of the invention.

What is claimed is:

1. A package for cut flowers comprising a supporting sleeve having opposed sides with upper and lower edges, at least one pair of slots in the upper edges of opposed sides of the sleeve, and a cut flower supporting card having openings adapted to receive the stems of the cut flowers, said card being formed with shaped means at its sides which engage the slots to suspend the card within the sleeve in thereby support and protect the cut flowers.

2. The package of claim 1, including a plurality of cards and associated spaced pairs of slots arranged to support the cut flowers with the flower heads spaced from each other to reduce damage during transportation and handling.

3. The package of claim 1, wherein each of the slots of the sleeve have a base and the shaped means of the card includes shaped lugs including slots for engaging the base of each side slot of the sleeve to locate and support the card.

4. The package of claim 1, wherein the side slots of the sleeve are arranged alternately at a first spacing and a second spacing wherein the first spacing is greater than the second spacing.

5. A cut flower transportation and storage package comprising a ventilated container capable of containing water, a package having a supporting sleeve mounted in said container, and a ventilated lid closing the top end of said sleeve to form said transportation and storage package.

6. The package of claim 2, wherein each of the slots of the sleeve have a base and the shaped means of the card includes shaped lugs including slots for engaging the base of each side slot of the sleeve to locate and support the card.

7. The package of claim 5, including a plurality of cards and associated spaced pairs of sleet slots arranged to support the cut flowers with the flower heads spaced from each other to reduce damage during transportation and handling.

8. The package of claim 5, wherein each of the slots of the sleeve have a base and the shaped means of the card includes shaped lugs including slots for engaging the base of each side slot of the sleeve to locate and support the card.

9. The package of claim 5, wherein the side slots of the sleeve are arranged alternately at a first spacing and a second spacing wherein the first spacing is greater than the second spacing.

10. The cut flower transportation and storage package of claim 5, wherein said package includes a supporting sleeve having opposed sides with upper and lower edges, at least one pair of slots in the upper edges of opposed sides of the sleeve, and a cut flower supporting card having openings adapted to receive the stems of the cut flowers, said card being formed with shaped means at its sides which engage the sleeve slots to suspend the card within the sleeve to thereby support and protect the cut flowers.

* * * * *